United States Patent [19]

Ahlström

[11] 4,278,182

[45] Jul. 14, 1981

[54] VENDING MACHINE

[76] Inventor: Allan Ahlström, Mahults Herrgård, Simlångsdalen, Sweden, 310 39

[21] Appl. No.: 73,325

[22] Filed: Sep. 7, 1979

[30] Foreign Application Priority Data

Sep. 8, 1978 [SE] Sweden ..... 7809454

[51] Int. Cl.[3] ..... G07F 11/24; G07F 11/32

[52] U.S. Cl. ..... 221/5; 221/6; 221/14; 221/123; 221/267

[58] Field of Search ..... 221/2, 4, 5, 6, 12, 221/13, 14, 17, 18, 123, 133, 151–153, 251, 267, 273, 274, 275

[56] References Cited

U.S. PATENT DOCUMENTS

| | | | |
|---|---|---|---|
| 480,431 | 8/1892 | Larsen | 221/274 X |
| 1,444,863 | 2/1923 | Baird | 221/5 X |
| 1,807,404 | 5/1931 | Goss | 221/123 |
| 1,896,137 | 2/1933 | Eckmann | 221/5 |
| 2,373,014 | 4/1945 | Compton et al. | 221/123 |
| 2,777,603 | 1/1957 | Baum | 221/5 X |
| 2,799,430 | 7/1957 | Kintzel | 221/123 X |

FOREIGN PATENT DOCUMENTS

| | | | |
|---|---|---|---|
| 626152 | 2/1936 | Fed. Rep. of Germany | 221/5 |
| 269946 | 11/1950 | Switzerland | 221/123 |

*Primary Examiner*—Robert J. Spar
*Assistant Examiner*—Edward M. Wacyra
*Attorney, Agent, or Firm*—Cantor and Singer

[57] ABSTRACT

In a vending machine, where the items are stored in separate, vertical compartments from the lower ends of which items are removable, one by one, by a selector mechanism comprising a displaceable frame, which embraces three sides of the battery. A front member of the frame carries a sensor, which reacts if a selected compartment should be emptied down to a predetermined level, and a rear member includes a feeding-out finger connected to an actuating mechanism. This is operated by an electric motor, and a governing circuit comprising two switches, which are operated by the position of the frame in relation to the battery, and by the reaction of the sensor at the selected compartment, respectively.

9 Claims, 6 Drawing Figures

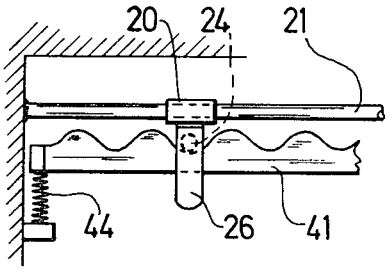
FIG. 4
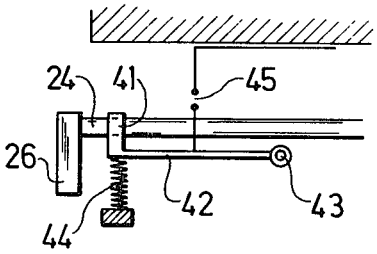
FIG. 5
FIG. 6
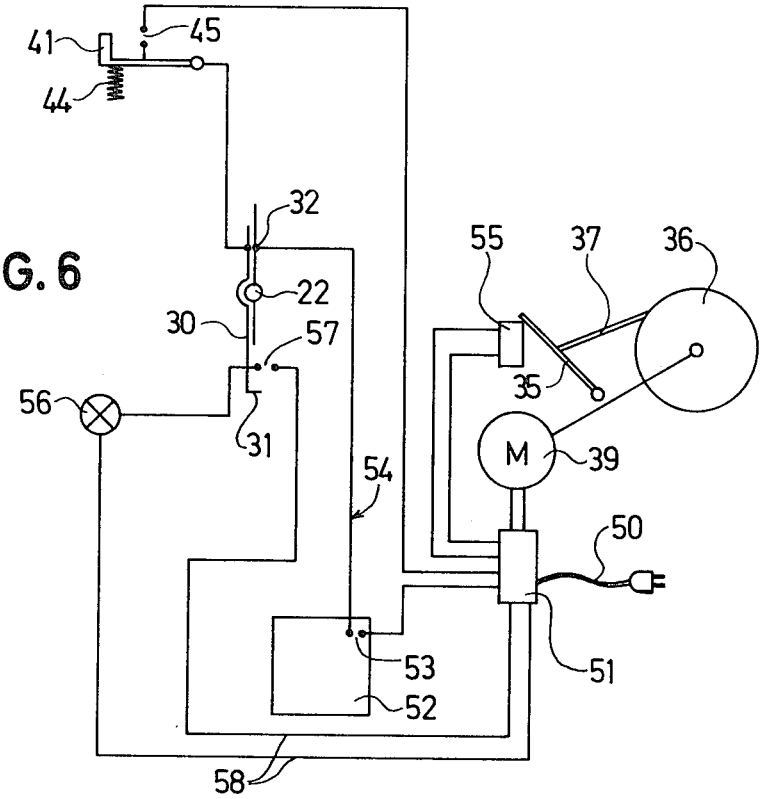

VENDING MACHINE

BACKGROUND OF THE INVENTION

There are many types of vending machines suited for the distribution of goods of various kinds. Goods items encased in a uniform, rigid wrapping, such as beverages in cans, and various preserves, cigarettes and other goods in boxes may be located in separate, vertical compartments, built together to a battery. In such a manner it is possible to provide a vending machine, requiring a small space, but containing a large number of items. By means of a selector mechanism, releasable in any suitable manner, it is possible to remove items, one by one, from the bottom of a selected compartment.

SUMMARY OF THE INVENTION

The present invention refers to vending machines of the type above referred to, and the aim is to propose a selector mechanism of a simple and expedient construction, which will require a small space within the machine, and which will be automatically blocked, should a selected compartment be occasionally empty.

A selector mechanism according to the invention includes a frame, displaceable along the battery and comprises a rear and a front member, as well as a top member inter-connecting the same, said members together enclosing three sides of the battery of compartments. The front member is provided with a sensor for the goods items, while the rear member comprises a feeding-out finger operable by an actuating mechanism.

The actuating mechanism preferably includes an electric motor operable by the release mechanism. A control circuit for the motor further includes two switches, which are operable respectively in response to the position of the frame in relation to the battery, and to the reaction of the sensor at a selected compartment.

The top member of the frame is preferably connected to a handle, accessible at the outside of the machine, and a cam-rack shaped actuator for a switch runs along the top of the battery, and is operable by means of the handle.

The front member of the frame preferably comprises a lower arm, which is pivotably supported in an upper portion of the member, and at its lower end carries the sensor, level with the lower ends of the compartments, and is adapted to actuate a switch if the sensor is brought to an empty compartment. The sensor is advantageously formed like a trundle, rotatable about a substantially vertical axis.

The feeding-out finger at the rear member of the frame may be arranged at an angle to the member, and an opening for the introduction of the finger is provided at each compartment, level with the lowermost good's item therein.

The actuating mechanism preferably comprises a horizontal bar, running parallel to the battery and behind the same, and is mounted upon arms, which are swingable by means of the driving motor, the rear member of the frame including a forked portion, which in the transient position of the frame embraces the bar with a vertical clearance.

BRIEF DESCRIPTION OF THE DRAWINGS

FIG. 4 shows a front view of part of the cam-rack shaped actuator member, FIG. 5 shows a side view of the mounting of the actuating member, and FIG. 6 shows a governing circuit for the electric motor of the actuating mechanism.

DESCRIPTION OF SOME PREFERRED EMBODIMENTS

Figure 1:
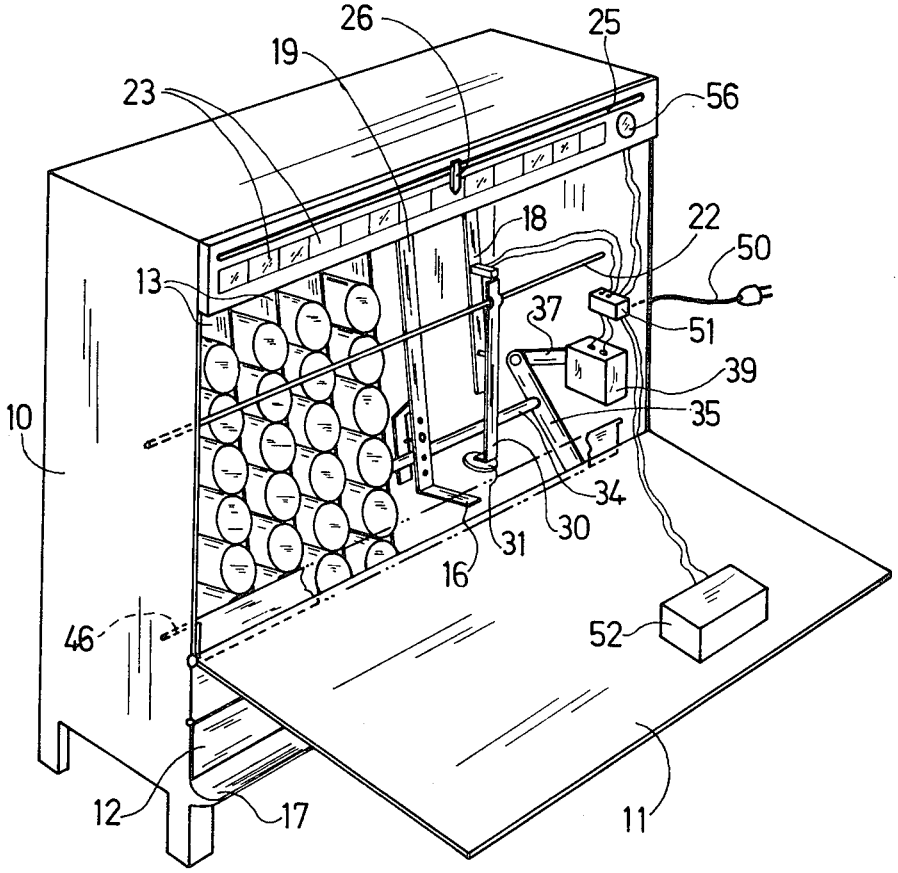
FIG. 1 schematically shows the machine, with its front folded down, and a number of compartments removed in order better to show the selector mechanism.

The vending machine schematically shown in FIG. 1 is formed as a narrow cabinet 10 having a downwardly foldable front 11 and a lower removing gate 12, which is pivotable about its upper longitudinal edge.

Within the cabinet there are a number of vertical compartments 13, adapted to hold cans 14 of a standardized size, lying down. Each compartment 13 is defined by three vertical sides and a fixed bottom. The back of each compartment has, in its lower end, an opening 15 through which a feeding-out finger 16, in the manner to be desribed below, may be introduced for forcing the lowermost can in the compartment outwards. During this movement the can will swing gate 12 outwards, and it will finally fall down into a receiver 17, from which it may be retrieved.

For the sake of easier understanding FIG. 1 shows a few compartments only, whereby the selector and actuator mechanisms will be better visible.

Figure 2:
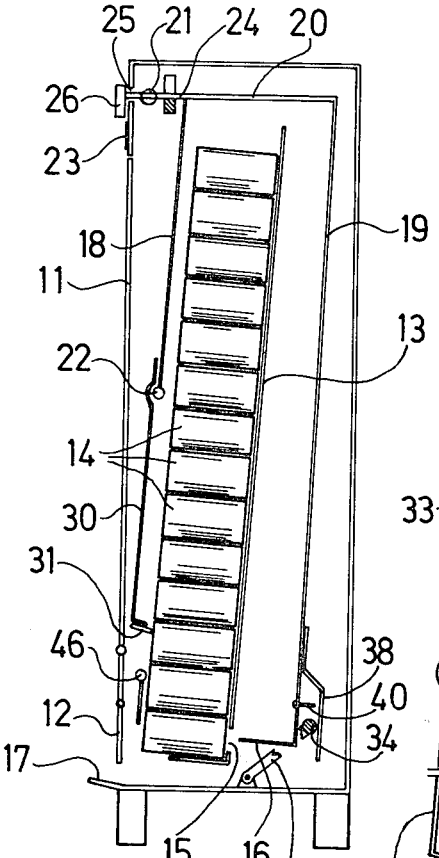
FIG. 2 shows a vertical section through the machine.

The selector mechanism—see also FIG. 2—comprises a frame including a front member 18, a rear member 19, and a top member 20, interconnecting the two first-mentioned members. The frame will thus embrace three sides of the battery formed by the compartments 13, and it may be displaced sidewardly along the latter. The frame is carried by two horizontal guides, of which one, 21, is located in front of, and above the battery, and the other, 22, is located in front of the battery, about at its middle portion.

The upper part of the cabinet carries a row of signs 23, describing the content of the goods provided in the compartments 13, located behind the signs. The top member of the frame is extended by an arm 24, which projects through a horizontal slot 25 in the front wall of the cabinet, and is terminated by a handle 26, which is used to move the frame to a position at a selected compartment.

The arm 24 is, in the manner to be desribed below in connection with FIGS. 5 and 6, adapted to actuate a switch which breaks the current to a driving motor if the frame is not brought to a proper position in relation to the selected compartment.

The front member 18 of the frame is extended downwards by an arm 30, which is pivotably or resiliently mounted in relation to the main body of the front member, and which, at its lower end, carries a sensor 31, formed as a trundle, rotatable about a vertical axis.

As is best evident from FIG. 2, the battery is mounted in such a manner, that the longitudinal axes of the cans 14 will be inclined downwardly/rearwardly in relation to a horizontal plane. This means that the cans will rest safely in the compartments, and reduce the spaces necessary for moving finger 16 along the back of the battery.

The finger 16 is, from behind, pushed through an opening 15 in a selected compartment, and will then move the lowermost item therein outwards. In order to prevent the next but lowermost item from moving from its position, a horizontal bar 46 is provided, to run along the next but lowermost items, level with their top portions, and which carries a pivotable flap, which normally hangs down in front of the lowermost items.

The sensor 31 is, in the embodiment shown, arranged level with the third items from the bottom of the stacks. The trundle will run smoothly along the outwardly turned faces of the items, when the frame is being moved.

It may be advantageous to arrange sensor 31 some steps further up along the stack. When distributing chilled beverages a signal should preferably be issued before the compartment is completely empty. With the arrangement shown there will always be at least two chilled units after a refilling of the compartment.

Arm 30 carries a switch 32 at its upward end, and is biased, for instance by means of a spring 33, so sensor 31 is forced against the compartments.

Should the frame be brought to a position in front of a compartment, where only two items remain, the sensor 31 will swing into the compartment, as there is no third item to rest against. Switch 32 will then break the circuit to the driving motor in the manner to be described in connection with FIG. 6.

Figure 3:
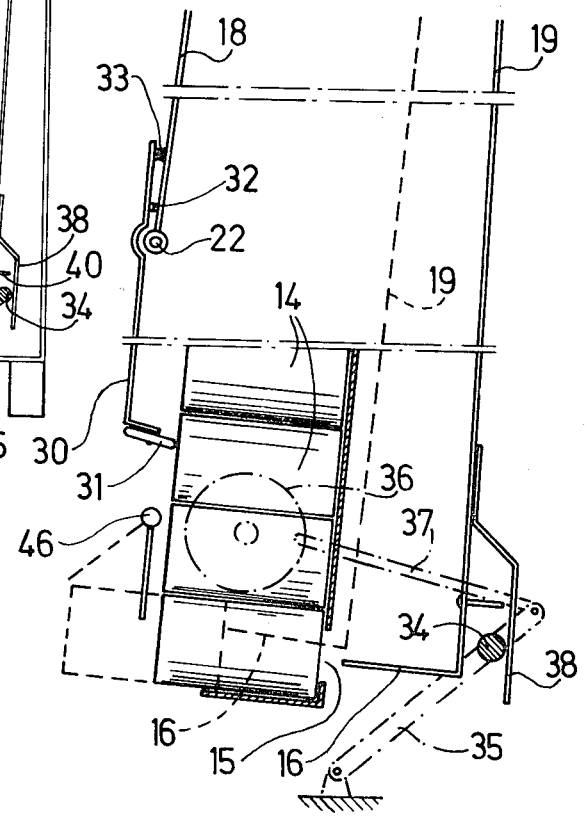
FIG. 3 shows a detail of the selector mechanism at the lower portion of the battery.

An actuating mechanism for finger 16 is schematically shown in FIG. 3. The rear member 19 of the frame hangs down from the upper guide 21. A horizontal bar 34 runs along the battery, behind member 19, and about at its lower end. This bar is, at its both ends, suspended by swingable arms 35. One of those arms is operated by a crank mechanism comprising a rotatable disc 36 and a link 37.

The rear member is provided with a projection 38, which together with the lower portion of the member, like a fork, embraces bar 34, and in the normal moving position of the frame leaves a vertical clearance in relation thereto.

The disc 36 is rotated by a motor 39, which is governed by the circuit shown in FIG. 6.

Due to the vertical clearance, finger 16 will be moved substantially horizontally, in spite of the swinging movement of bar 34, and will then push the lowermost item outwards from the stack.

The actuating mechanism is schematically illustrated in order to indicate the desired function at finger 16.

A screw 40 is provided at projection 38, and may be located in one of the holes in a vertical row of holes, in order to determine the vertical clearance.

The movement of finger 16, above described, presupposes that the frame is correctly located in relation to the selected compartment. As is mentioned above, arm 24 at the top member 20 of the frame will actuate a switch.

An actuating member for the latter is shown in FIGS. 4 and 5 and comprises a cam-rack shaped member 41, which extends along the battery. The upper edge of this member forms a series of peaks and valleys, and it is arranged so a valley will be located just in front of each compartment.

The cam-rack member 41 is carried by two arms 42, which are pivotable about pins 43, and is maintained in raised position by means of springs 44.

The cam-rack 41 will be depressed each time arm 24 passes a peak, but the arm has an inherent tendency to stay in a valley, and it will be easy to locate the frame in a correct position.

Adjacent to one of arms 42 there is a switch 45, which is included in the governing circuit of the driving motor 39, and which will be closed only when arm 24 rests in the middle of a valley, so cam-rack 41 can be lifted to its upper position.

A governing circuit for the driving motor is shown in FIG. 6.

Current is in a conventional manner supplied by a cable 50, which by means of a plug contact can be connected to a suitable source of supply. The governing current preferably is a transformed low-current and actuates a control device 51 of arbitrary known type.

An important component in the governing system is the release mechanism 52, which will permit the removal of an item. The release mechanism may be a coin mechanism of arbitrary known type, which closes a switch 53 in circuit 54, when the required number of coins has been inserted. Other types of release mechanisms may of course be used, for instance those which are operated by a key, or by a check, which is stamped when an item is removed. In order that the governing circuit shall be operable it is, as above mentioned, necessary that switch 32, which is actuated by sensor 31 at the front member of the frame, as well as switch 45, which is actuated by cam-rack member 41 operable by the handle, are closed.

It is further important that an accidental movement of the handle, or the removal of an item from a compartment, does not break the circuit before the actuating mechanism 35–37 has terminated its movement, and finger 16 has returned to a position behind the battery. In connection with the actuating mechanism a double switch is provided, preferably operated by arm 35, which switches-in a relay 55, as soon as the mechanism starts to move, but which will not be cut out until the mechanism has performed the necessary movement.

The actuating mechanism may, as mentioned above, be designed in various ways, and relay 55 may be arranged to reverse the direction of rotation at the driving motor, so disc 36, instead of always rotating in the same direction, will perform the required movement rotating in one direction, and then is rotated backwards.

Adjacent to the row of signs 23 there is a signal lamp 56, which is lighted if sensor 31 falls into an empty compartment. Arm 30 at the front member of the frame carries a second switch 57, which is normally open, but which will close a circuit 58 to signal lamp 56, when sensor 31 swings inward.

The embodiment above shown and described is an example only, the details of which may be varied in many ways within the scope of the appended claims.

The number and size of compartments 13 will have to comply with the types of goods to be dispensed, and for certain goods it is advantageous to provide a refrigerator within the cabinet.

Gate 12 at receiver 17 may be locked in any suitable manner, for instance by means of a link to the actuating mechanism, so the gate may be swung out, only when a release operation is initiated.

What I claim is:

1. A vending machine comprising a number of separate, vertical compartments arranged to form a flat battery, from the lower end of which items are singularly retrievable under the control of a release mechanism, each of said compartments being defined by two side walls, a back wall and a bottom, an opening in the back wall of each compartment adjacent to its bottom, a selector mechanism including a frame embracing three sides of said battery and comprising a front member, a rear member and a top member interconnecting said rear and front members, two horizontal guides for carrying said frame while permitting displacement thereof along said battery, a handle on said top member for manual displacement of said frame, a sensor carried by said front member, a feeding-out finger on said rear member adjacent said opening, and an actuating mechanism for reciprocating said feeding-out finger in and out said opening in the back of a selected compartment.

2. The vending machine according to claim 1, in which said actuating mechanism includes an electric motor operable by said release mechanism, and where a control circuit for said motor further includes first and second switches, said first switch operable in response to a selected position of the frame in relation to the battery, and said second switch operable in response to the reaction of said sensor at a selected compartment.

3. The vending machine according to claim 2, in which the means for operating said first switch includes a cam-rack shaped actuator running along the top of the battery and movable by means of said handle.

4. The vending machine according to claim 2, in which said front member of the frame includes a lower arm, which is pivotably supported in an upper portion of the member, and at its lower end carries said sensor, about level with the lower ends of the compartments, said arm actuating said second switch when the sensor is brought to an empty compartment.

5. The vending machine according to claim 4, in which said sensor is formed liked a trundle, rotatable about a substantially vertical axis.

6. The vending machine according to claim 4, further including a blocking bar located level with the penultimate items in said compartments of the battery, and said front portion of the frame, with its lower arm having such a length tht said sensor will move along the row of items just above said blocking bar.

7. The vending machine according to claim 1, in which said feeding-out finger on the rear member of said frame is arranged at an angle to the member, said actuating mechanism comprising a horizontal bar, running parallel to said battery and behind the same, said bar being mounted upon arms, which are swingable by means of said electric motor and said rear member of the frame including a forked portion, which in the transient position of the frame embraces said bar, with a vertical clearance.

8. The vending machine according to claim 7, further including means for adjusting said vertical clearance.

9. The vending machine according to claim 7, further including a signal lamp controlled by said sensor for indication of an empty compartment.

* * * * *